United States Patent [19]

Lindqvist

[11] 4,020,551

[45] May 3, 1977

[54] ICE-PROD

[76] Inventor: Lars-Hakan Lindqvist, Solrosstigen 1, 133 00 Saltsjobaden, Sweden

[22] Filed: Jan. 26, 1976

[21] Appl. No.: 652,521

[30] Foreign Application Priority Data

Jan. 31, 1975 Sweden ..... 7501129

[52] U.S. Cl. ..... 30/164.8; 30/152; 224/2 D; 294/26

[51] Int. Cl.[2] ..... B26B 29/00

[58] Field of Search ..... 294/25, 26; 224/2 D; 9/14; 30/164.5, 164.7, 164.8, 296 A, 299, 152, 143; 248/216, 217

[56] References Cited

UNITED STATES PATENTS 3,305,984 2/1967 Borcuk ..... 30/164.8

FOREIGN PATENTS OR APPLICATIONS 437,253 6/1948 Italy ..... 294/26

*Primary Examiner*—James L. Jones, Jr.
*Assistant Examiner*—J. C. Peters

[57] ABSTRACT

Ice-prod with tips furnished with handles and a flexible device of a given length, which couples two ice-prods together, the tips of the prods being at an angle of about 45° to the longitudinal axis of the handles.

10 Claims, 3 Drawing Figures

ICE-PROD

Figure 1:
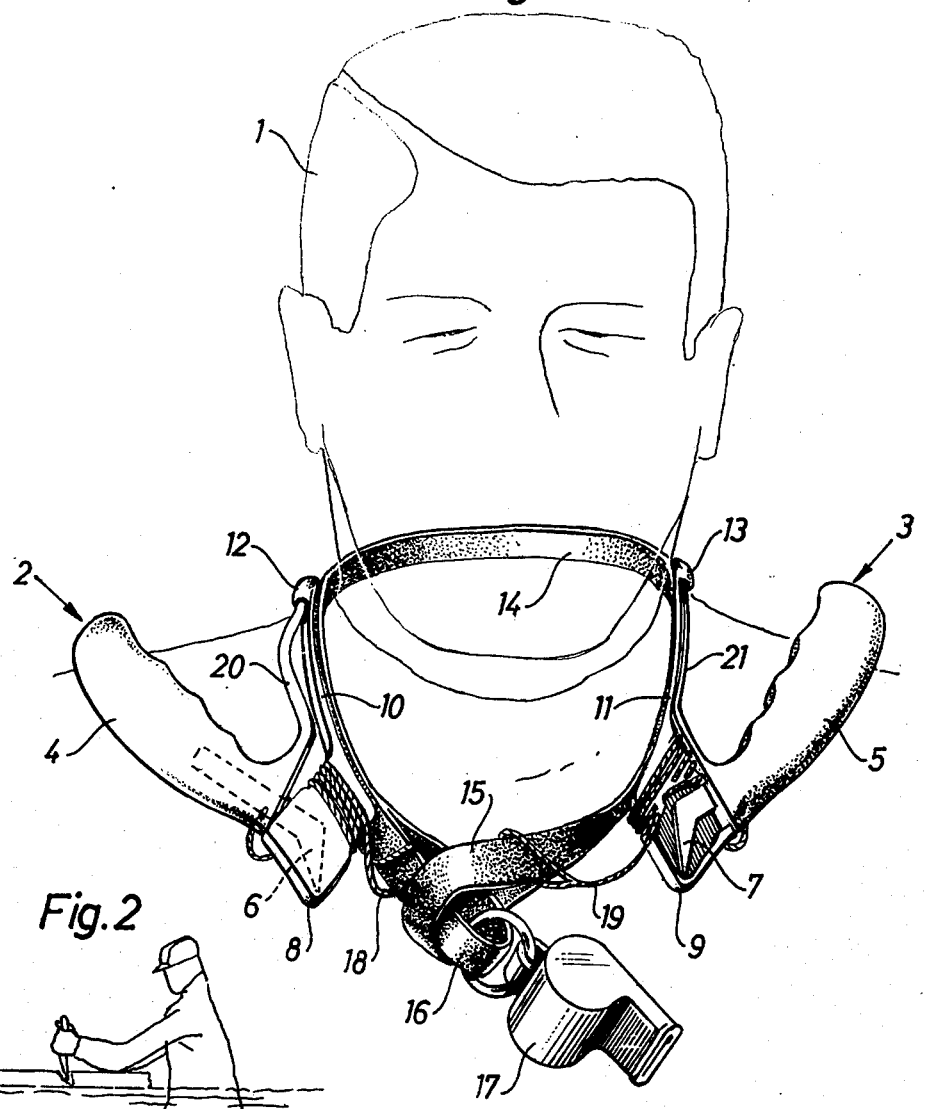

The invention relates to an ice-prod with tips to which handles are attached and a flexible device of a given length which couples two ice-prods together.

Such ice-prods are known in several forms, the actual prod and its tip being coaxial with the longitudinal axis of the handle. These prods are joined together by a roughly 2m long cord which is placed around the user's neck, after which the handles are placed side by side and the cord is wound around them. The prods and the wound cord are then placed, readily accessible, in for example a breast-pocket. Each prod with wound cord can, of course, be placed separately in a breast-pocket on each side or, for example, on carrier-straps on a rucksack. Another known method is to have the prods hanging round the neck in a special collar-like device so that they shall be quickly accessible when needed.

A common feature of known ice-prods is that they must be driven into the ice, which may often weaken or even crack thin layers of ice. The prods are usually used, moreover, with bent arms, the elbows being braced against the edge of the ice, which then often gives way.

The object of the present invention is wholly or at least partially to eliminate these drawbacks and to propose a new form of prod which need not be driven into the ice but can be used with straight, extended arms so that the weight of the body can be distributed over a greater area and weaken the ice as little as possible. The prods shall, furthermore, be readily accessible when required without being in the way when not in use. They shall also be immediately accessible without needing to remove gloves to unbutton a breast-pocket, for example, to get at the prods. In other words the prods shall always be in a state ready for use.

This is achieved according to the invention by means of a prod of the aforementioned kind through the fact that the tips are inclined at an angle—preferentially about 45° — to the longitudinal axis of the handles.

It is also proposed according to the invention that the handle, on its long-side opposite to the tip of the prod, be provided with a knuckle-guard which at the same time prevents the prod from being turned with the tip in the wrong direction when it is to be used. Owing to the roughly 45° backward-inclining tip the prod embeds itself in the ice. It need accordingly not be driven into the ice. It need accordingly not be driven into the ice, so can be used with straight, extended arms, which distributes the weight over a larger area and permits the user to "swim" up onto the ice instead of, as with ordinary prods, having to heave oneself up on the ice, so often breaking the edge of the ice. The ice-prod according to the invention, furthermore, does not crack the ice, as it is not driven into it. Owing to the form of the handle with a knuckle-guard the handle automatically settles in the hand the right way round. To reinforce this effect and further ensure that the prod is automatically gripped with the tip pointing in the correct direction, i.e. backward toward the user, it is proposed according to one embodiment of the invention that the handle should have elevations and depressions for the fingers on its side facing the knuckle-guard. Owing to the backward-inclining tip in combination with the form of the handle and the knuckle-guard, no great muscular force is required to hold the tip against the ice at the correct angle.

The knuckle-guard is used according to a further development of the invention also in a third respect, namely for holding the ice-prod in ready-for-use position in a sheath. According to another proposal the sheath has a portion for receiving the tip, an oblong portion running along the knuckle-guard, and a snap-fastening or slide-in portion for receiving the free end of the knuckle-guard. The sheath can also be formed for winding up of a flexible cord or part thereof for joining two ice-prods together. By making the sheath, for example, slightly convergent outward from the oblong portion, the cord can easily glide off it when the ice-prod is removed from the sheath for use.

It is also proposed that the sheath and the snap-fastening or slide-in portion be attached to a collar which holds the ice-prods and handles outward-turned in an easily grippable ready-to-use position. The collar should preferentially be furnished with a loop, at least at one end, and with a whistle at the other end, the whistle and loop being so formed that they function as button and buttonhole to hold together the ends of the collar. The collar thus constitutes a part of the flexible device coupling the two ice-prods together, the ends of the cords remote from their associated prod handles being attached to the collar. Through this construction the prods are always easily accessible without constituting a risk of damage to the user or getting in the way. The collar has the advantageous effect of turning the sheath so that the handles are turned obliquely outwardds and can be very easily gripped even when wearing gloves. The knuckle-guard and the oblong portion should preferably be made of material that is elastically flexible even in winter-cold, it then being necessary merely to pull the ends of the handles outward so that the knuckle-guard is bent and snaps out of the sheath to be released for use.

The invention will now be described with reference to an embodiment shown in the attached drawing, FIG. 1 showing a pair of ice-prods with prod sheaths and collar ready for use round a person's neck, FIG. 2 a person in distress attempting to get out of an ice-hole with conventional prods, and FIG. 3 a person in distress using the prod according to the invention.

In FIG. 1 is shown only schematically a person's head 1, around whose neck is placed a safety device with two ice-prods 2, 3 according to the invention. Each ice-prod 2, 3 has a handle 4, 5. Each handle has at its lower end a prod, the tips 6, 7 of which are inclined about 45° outward relative to the longitudinal axes of their prod handles. The tips 6, 7 are inserted in and protected by a prod sheath 8, 9 so that they can cause no damage or get in the way. To each sheath 8, 9 is here connected an oblong portion 10, 11 terminating in a snap-fastening or slide-in portion 12, 13 designed to receive a knuckle-guard 20, 21 projecting from the handle 4, 5 close to the attachment of the prod tip 6, 7 on the long-side of the ice-prod 2, 3 opposite to the actual tip 6, 7. The oblong portion 10, 11 may also be eliminated and the snap-fastening or slide-in portion 12, 13 then constitutes a separate part. Said knuckle-guard 20, 21 not only protects the hands if the prods are used without gloves, but has the additional function of securing the prod, easily detachably, to the part consisting of the prod sheath 8, 9, the oblong portion 10, 11, and the snap-fastening or slide-in portion 12, 13. Both the knuckle-guard 20, 21 and the oblong portion 10, 11, if any, consists of material that is elastically flexible even in the cold of winter so that — as indicated on the left of FIG. 1 — the ice-prod need merely be gripped at the handle and pulled aside to be immediately ready for use. A cord 18, 19 attached to the ice-prod 2, 3 is wound around the associated prod sheath 8, 9 and, after withdrawal of the prod from the sheath, can easily glide off it.

The prod-holders consisting of the parts 8-13 are attached to a collar 14 which, in the embodiment shown in FIG. 1, has loops 15, 16 at its ends. One loop 16 may also be eliminated. At this end, in the present case, has been attached a whistle 17 which at the same time serves as a button engaging with a "buttonhole" in the form of loop 15. The whistle 17 is thus always accessible for the issue of whistle signals to summon help if needed. At the same time it holds together the ends of the collar 14. To the loops 15, 16 are also attached the aforesaid cords 18, 19, whereby the collar 14 constitutes a part of the flexible coupling between the ice-prods 2, 3.

If the collar 14 is made in the form of a rigid textile collar, it assists in holding the handles of the ice-prods in an outward-turned, easily grippable ready-to-use position.

Figure 2:
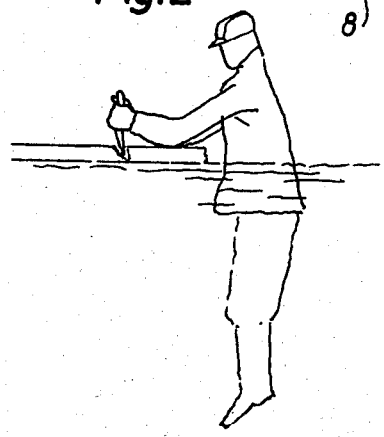

FIG. 2 shows a person in distress attempting to get out of an ice-hole with conventional ice prods. As appears from the drawing, the person rests his elbows against the edge of the ice and drives the prods obliquely into the ice, whereby there is a risk that the already weak edge of the ice may break. If the ice is everywhere weak, accordingly, it is difficult to get up onto the ice without repeatedly falling through it.

Figure 3:
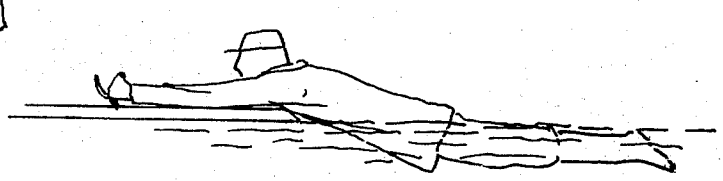

FIG. 3 shows how, with the ice-prods according to the invention, a person in distress, as it were, swims up onto the ice with extended straight arms. The prod need not be driven into the ice, so that the strain on the wrists is eased. Since the tips of the ice-prods are backward-directed, they dig into the ice without needing to be driven in, so that the ice does not become appreciably weakened or crack. Since one can work with straight arms, the whole length of the arm can be optimally utilized to draw oneself up on the ice. Practical trials have shown that in this way the weight of the body can be distributed over a larger area, which makes it easier than was previously possible to raise oneself onto weak ice without again breaking through the crust. The form of the prod handles has proved to ensure, even when a person is in a panic, that the prods are automatically turned in the correct direction.

Although the invention has been described with reference to one of its embodiments, it can nevertheless be arbitrarily varied within the scope of the subsequent claims.

What is claimed is:

1. An ice-prod self-rescuing set comprising, a flexible collar adapted to be worn about the neck of the user, a pair of sheaths ecured to said collar in a position readily capable of being reached by the user, and a pair of prods adapted to be held respectively in each sheath, said prod comprising an angular ice-engaging tip and a handle extending from one end thereof, said handle having a knuckle guard projecting from the tip outwardly and to the rear of said handle to insure that when grasped by the user the prod is automatically turned with its tip in the correct position for use.

2. The set according to claim 1, in which each sheath comprises a first portion to receive the tip of the prod in ready-to-use position and a second portion adapted to receive the knuckle-guard.

3. The set according to claim 2, wherein said second portion and the end of said knuckle-guard are provided with cooperating fastening means to hold said knuckle-guard securely.

4. The set according to claim 1, in which each of said handles on its side facing the knuckle-guard is provided with elevations and depressions conforming to the user's fingers to further insure that the prod is automatically turned with the tip in the correction direction when it is to be used.

5. The set according to claim 3 wherein said second portion is generally oblong and is secured to said collar and ends in a snap-fastening portion to receive the free end of the knuckle-guard.

6. The set according to claim 1, wherein said knuckle-guard is formed of material flexible under cold temperatures.

7. The set according to claim 5, wherein said oblong sheath is formed of material flexible under cold temperatures.

8. The set according to claim 1, wherein each of said sheaths is adapted to receive a wound up flexible cord which secures the associated prod to the said collar, said sheath being formed to permit said cord to slide from the sheath when the prod is removed.

9. The set according to claim 1, wherein one end of collar is provided with a loop, and the other end of said collar is provided with means engaging said loop to hold the ends of the collar together.

10. The set according to claim 9, in which the engaging means includes an emergency whistle.

* * * * *